US005815190A

United States Patent [19]

Ohshima et al.

[11] Patent Number: 5,815,190

[45] Date of Patent: Sep. 29, 1998

[54] IMAGE FORMING METHOD, IMAGE FORMING APPARATUS AND IMAGE FORMING MEMBER

[75] Inventors: Katsuyuki Ohshima; Takeshi Ueno; Mineo Yamauchi; Tatsuya Kita, all of Tokyo, Japan

[73] Assignee: Dai Nippon Printing Co., Ltd., Tokyo, Japan

[21] Appl. No.: 658,069

[22] Filed: Jun. 4, 1996

Related U.S. Application Data

[62] Division of Ser. No. 213,558, Mar. 16, 1994, Pat. No. 5,550,099, which is a division of Ser. No. 809,501, filed as PCT/JP91/00600, May 7, 1991, Pat. No. 5,318,941.

[30] Foreign Application Priority Data

| | | | |
|---|---|---|---|
| May 7, 1990 | [JP] | Japan | 2-117209 |
| Aug. 4, 1990 | [JP] | Japan | 2-207037 |
| Feb. 19, 1991 | [JP] | Japan | 3-045382 |

[51] Int. Cl.[6] ..... B41J 2/325

[52] U.S. Cl. ..... 347/171; 347/172; 347/174; 347/176; 347/217

[58] Field of Search ..... 283/86, 109; 347/171, 347/217, 213, 212, 172, 174, 176; 400/120.01, 120.18, 120.02, 120.04

[56] References Cited

U.S. PATENT DOCUMENTS

| | | | |
|---|---|---|---|
| 5,006,502 | 4/1991 | Fujimura et al. . | |
| 5,011,570 | 4/1991 | Ohbayashi . | |
| 5,064,807 | 11/1991 | Yoshida et al. . | |
| 5,267,755 | 12/1993 | Yamauchi et al. | 283/86 |

FOREIGN PATENT DOCUMENTS

| | | |
|---|---|---|
| 0266430 | 7/1989 | European Pat. Off. . |
| 8902372 | 3/1989 | WIPO . |

OTHER PUBLICATIONS

Patent Abstracts of Japan, vol. 12, No. 272 (M–724), Jul. 28, 1988 JP(A) 63–053095 (Abstract).

*Primary Examiner*—Huan H. Tran
*Attorney, Agent, or Firm*—Dellett and Walters

[57] ABSTRACT

According to the present invention, a gradation image such as photographs and a non-gradation image read by an image processing means 13 of FIG. 2 are edited and laid out. Based on the data file, a dye receiving layer 21 is formed on a gradation image forming area on a paper mount 26 of FIG. 3 by image generating means 18, and a gradation image 22 is formed by thermal transfer method on said dye receiving layer. A non-gradation image 23 such as character combined with the gradation image is printed before and after the formation of the gradation image. Further, a protective layer 24 is formed on the gradation image 22 or the non-gradation image 23 when necessary, by protective layer transfer means incorporated in the image forming means 18. Thus, a card such as a visiting card 20 with a photograph or a booklet such as a passport can be prepared. The gradation image and the non-gradation image can be transferred on plain paper, and by limiting the receiving layer area to the gradation image area, it is possible to form the images without impairing texture feeling and writability as plain paper.

When the image is formed using a thermal transfer image receiving sheet with an arbitrary pattern (such as ground pattern), such pattern forms a background for the image, and this makes it possible to prevent falsification or alteration.

9 Claims, 11 Drawing Sheets

IMAGE FORMING METHOD, IMAGE FORMING APPARATUS AND IMAGE FORMING MEMBER

This application is a divisional of copending application (s) Ser. No. 08/213,558 filed on Mar. 16, 1994, U.S. Pat. No. 5,550,099, which is a divisional of U.S. Pat. No. 07/809,501, filed Jan. 6, 1992, now U.S. Pat. No. 5,318,941. International Application PCT/JP91/00600 filed on May 7, 1991, and which designated the U.S.

FIELD OF THE INVENTION

The present invention relates to an image forming method, an image forming apparatus and an image forming member, by which it is possible to form a gradation image such as a photograph of face, landscape, etc. on visiting card, post card, advertising leaflets, personal history statement, personal record, identification card, driver's license, season ticket, membership card or other paper mount, or plain paper, or to form a non-gradation image such as characters, symbols, etc., to easily form a gradation image such as photograph of face on a desired area of passport, pocketbook, coupon ticket booklet, notebook, etc. in order to prevent alteration and falsification.

TECHNICAL BACKGROUND

It is now often mandatory to print not only characters and symbols, but also gradation image such as photograph of face of a person or a product on papers, cards, etc. such as visiting card, post card, advertising leaflets, personal history statement, personal record, identification card, etc. For example, visiting cards are now widely used as a kind of identification cards regardless of the type of profession, and it is now practiced to use a photograph of face of the bearer on a part of visiting card in order to increase the credibility of the visiting card.

As a method to add a photograph of face of the bearer on a visiting card, there is a method to attach a photograph of face, photographed or printed, on a mount of the visiting card, but this method is expensive and complicated. There is another method to provide a photograph of face by printing it when the visiting card is produced. Because the visiting cards are produced usually not in very large quantity, this requires expensive cost and long time until the visiting cards are completed, thus resulting much inconveniences.

Such problem is not limited to the visiting cards, but it occurs in the cases of paper mounts on various types of greeting cards, such as new year cards, letter of appreciation to the attendant in wedding ceremony, report on birth of a child, etc.

In general, to form characters, symbols and photographic images on plain paper at the same time, general-purpose photogravure or offset printing are widely used. However, expensive photoengraving and printing processes are required for such methods, and this results in the problem of cost in case of small-lot printing of several to several tens of copies although there is no such problem if printed in large quantity such as several thousands to several tens of thousand copies.

To solve the problem, various types of personal printers have been developed for personal use. However, it is difficult to form a gradation image such as photograph of face by heat fusion type thermal transfer. On the other hand, sublimation type thermal transfer can provide excellent gradation reproducibility and color reproducibility and can provide characters, symbols, etc. at the same time with a gradation image such as photograph of face, whereas special-purpose image receiving paper having resin layer in the surface is required.

FIG. 1 shows a transfer mechanism in such sublimation transfer method. In the figure, a transfer film 1 comprises a heat-resistant smooth layer 1*a*, a transfer base material 1*b* and dye layer 1*c*, which are laminated via primer for the better adhesion to the coating material. A film with easily adhesive treatment may be used. The heat-resistant smooth layer 1*a* consists of a mixture of polyvinyl butyral, polyisocyanate, and phosphoric acid ester. The transfer base material 1*b* consists of polyethylene terephthalate, polyimide, etc., and the dye layer 1*c* consists of sublimation dye of indoaniline type, pyrazolone type, azo type, etc. and a binder of polyvinyl acetal, cellulose type, etc.

The image receiving paper 2 comprises a receiving layer 2*b* and an image receiving paper base material 2*a* laminated via primer. The receiving layer 2*b* consists of saturated polyester, polyvinyl chloride, etc., and the base material 2*a* consists of synthetic paper, foamed polyester, foamed polypropylene, etc., and a rear surface layer consists of binder, lubricant, etc. A film of polyvinyl chloride resin may be used as the image receiving paper.

Around a platen roll 3, an image receiving paper 2 is wound. A transfer film 1 is closely overlapped on it. By applying a thermal head 4 on back side of the transfer film 1 and by heating, the sublimation dye is heated, moved and attached on the receiving layer 2*b*. In a sublimation transfer method, the dye is moved to the receiving layer according to the applied heat, and a recording with gradation can be provided according to the heat for each pixel dot.

In such sublimation transfer method, the quantity of the sublimation dye of the thermal transfer film is controlled according to image information and an image is recorded. Therefore, it is necessary to have special-purpose paper, which has a receiving layer where the sublimation dye can be attached.

In the thermal fusion type thermal transfer method, it is impossible to provide a gradation image such as photograph of face, while special-purpose image receiving paper is needed for the sublimation type thermal transfer method. For this reason, the following method is known: On plain paper surface, a dye receiving layer is partially formed by transfer, and a gradation image is formed on this receiving layer, while a non-gradation image such as characters, symbols, etc. are formed by heat fusion type thermal transfer on the other area.

However, dye is attached on the dye receiving layer in this method, and the dye image has some sort of durability such as anti-scratching property, while the image formed by heat fusion type thermal transfer method uses wax as a vehicle. Thus, the image lacks anti-scratching property, and only the wax image is deteriorated during handling. This leads to the deterioration of the image quality as a whole.

To solve such problem, there is another method to provide a transparent protective film on the wax image, whereas this means the addition of one more process and results in more complicated procedure.

With rapid internationalization of business activities and the increased popularity of overseas sightseeing travel, more and more passports are issued, and there arises a problem of passport falsification with such trend. On a passport, a photograph of face of the bearer is attached together with character information such as address, name, bar code, etc. to certify personal status of the bearer.

To attach a portrait photograph on a passport, a photograph of face separately photographed is usually attached on a mount of the passport by an adhesive. As described above, however, this method is troublesome and results in higher cost. Also, smoothness of the surface is lost due to the irregularities on the surface, and this is one of the causes of the delay in the issuance of the passports. In a passport with the attached photograph, there is a problem of falsification or alteration by re-attaching another photograph. This problem is not limited to passports, and there are similar problems with pocketbook, coupon tickets, notebook, etc., for which it is desirable to attach such photograph.

By the image forming method based on the sublimation transfer as described above, a photograph of face is provided as dye is attached into a base material of a card. This ensures surface smoothness, and the prevention of alteration and falsification. However, this is not totally effective in eliminating alteration or falsification of photograph and other information by removing protective layer using solvents, acids, bases, etc.

The present invention is to solve the above problems.

It is an object of the present invention to readily provide a gradation image such as a photograph of face and a non-gradation image such as characters on a mount of paper on a card such as visiting card.

It is another object of the invention to provide a dye image and a wax image with durability without increasing the number of processes.

It is still another object of the invention to provide a gradation image and a non-gradation image such as drawings and graphics by heat-sensitive sublimation transfer method without impairing smoothness, feeling and writability of plain paper.

It is yet still another object of the invention to readily provide a gradation image such as a photograph of face and a non-gradation image such as characters on a passport or other object.

It is still further object of the invention to promote the prevention of alteration and falsification.

DISCLOSURE OF THE INVENTION

The image forming system for forming a gradation image such as photographic image and a non-gradation image such as characters on a paper mount according to the present invention is characterized in that there are provided gradation image inputting means (non-gradation generating means when necessary), image processing means comprising means adapting said image to non-gradation image, layout means for determining an arrangement of said two images, and data file generating means for preparing data corresponding to both images thus laid out, further forming means for forming a dye receiving layer on paper mount based on said data file, thermal transfer means for forming a gradation image on said dye receiving layer based on the data file, and means for forming non-gradation image when necessary.

Also, the present invention is characterized in that a wax image is printed on a material to be transferred by heat fusion type thermal transfer method, a dye receiving layer is formed in a wax image and other desired area, and a dye image is formed on said desired area by a sublimation type thermal transfer method.

Further, an image forming method for forming a gradation image and/or a non-gradation image on plain paper by thermal transfer method according to the present invention is characterized in that a dye receiving layer is formed only in an image area, and a desired gradation image and/or a non-gradation image are formed on said receiving layer by sublimation type thermal transfer method.

Further, the present invention comprises a member to be recorded where a receiving layer stainable with sublimation dye is formed and a thermal transfer sheet having a dye layer containing sublimation dye being pressed between a thermal head and a platen, and by driving the thermal head based on image information, the sublimation dye in the dye layer of the thermal transfer sheet is moved to the receiving layer which has been transferred on the member to be recorded to form an image thereon, and it is characterized in that said receiving layer is transferred to the member to be recorded based on the image information.

The system according to the present invention comprises receiving layer transfer means for transferring a receiving layer where stainable with a sublimation dye to a member to be recorded, sublimation transfer means for forming an image by moving the sublimation dye from the thermal transfer sheet having a dye layer containing the sublimation dye to a receiving layer of the member to be recorded, and image processing control means for outputting image information to receiving layer transfer means and sublimation transfer means and for controlling the two transfer means, whereby said image processing control means is provided with an image area identifying unit and drives and controls the receiving layer transfer means based on identification data from the image area identifying unit.

Further, a system according to the present invention is provided with an image processing control system, comprising a sublimation transfer means for forming an image by moving a sublimation dye from a thermal transfer sheet having a dye layer containing sublimation dye to a receiving layer of a member to be recorded, and an image area identifying unit, outputting image information to the sublimation transfer means and controlling the transfer means, and it is characterized in that said thermal transfer sheet is provided with a receiving layer where the sublimation dye placed sequentially with the dye layer, and said image processing control means drives and controls the sublimation transfer means based on the data identified at the image area identifying unit and transfers the receiving layer to the member to be recorded.

Also, the present invention is characterized in that, in an image forming booklet comprising a front cover, a back cover and one or more paper mounts, at least a part of the front cover, the back cover or the paper mounts fastened between these two covers is provided with a dye receiving layer to accommodate sublimation dye.

Further, a booklet for image forming according to the present invention comprises a front cover, a back cover and one or more paper mounts fastened between these two covers, and it is characterized in that a dye receiving layer is transferred to at least a part of the front cover, the back cover or the paper mounts to form an image on said dye receiving layer by thermal transfer method.

Further, a booklet for image forming according to the present invention comprises a front cover, a back cover and one or more paper mounts fastened between these two covers, and it is characterized in that an image sheet comprising sublimation dye is fastened or attached in advance.

Further, a booklet for image forming according to the present invention comprises a front cover, a back cover and one or more paper mounts fastened between the two covers, and it is characterized in that at least a part of the booklet is provided with an image by the sublimation dye.

Also, the present invention is characterized in that a transparent dye receiving layer is provided on a base material sheet, and a pattern as desired is formed between said dye receiving layer and the base material sheet.

Further, the present invention comprises a thermal transfer image receiving sheet where a transparent dye receiving layer is provided on a base material sheet through an arbitrary pattern, and an image is formed on said thermal transfer image receiving sheet using a sublimation type transfer film.

Further, the present invention comprises a thermal transfer image receiving sheet where a transparent dye receiving layer is provided on a base material sheet through an arbitrary pattern, and an image of sublimation dye is formed on said thermal transfer image receiving sheet, said pattern constituting a background for said image.

BEST MODE FOR CARRYING OUT THE INVENTION

Figure 1:
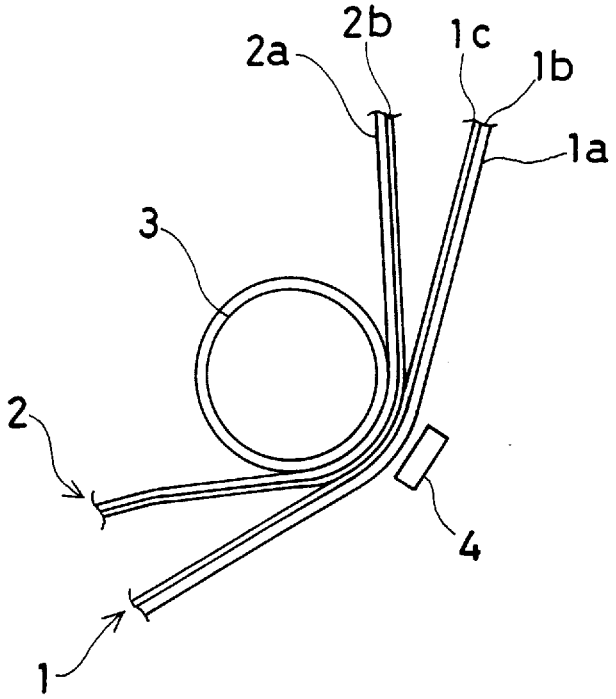
FIG. 1 is a schematical drawing of a conventional type heat-sensitive sublimation transfer recording apparatus.
Figure 2:
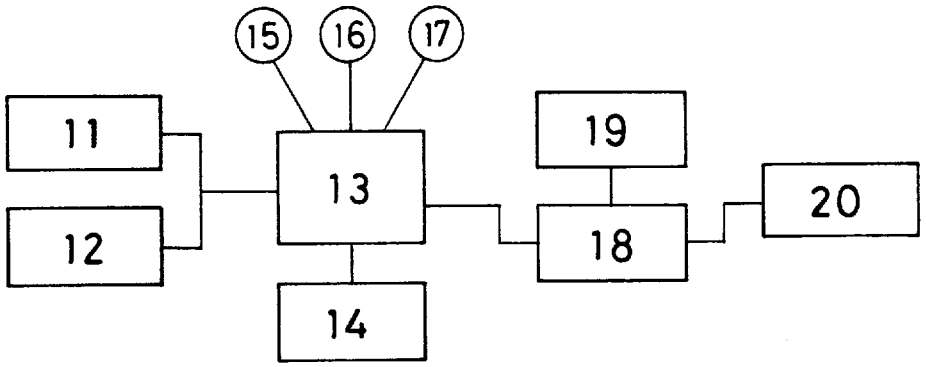
FIG. 2 is a schematical diagram of an image forming method according to the present invention.

Detailed description is given in an image forming method of the present invention, referring to a preferred aspect of the invention shown in FIG. 2.

A paper mount to be used in the present invention is preferably a paper card such as visiting card, post card or identification card, whereas it is not limited to a card type paper mount and may be a general paper mount of plain paper or wood-free paper or a plastic card.

A gradation image is inputted in image processing means 13 from gradation image inputting means such as a CCD scanner 11 or a camera 12. Driving a computer such as a personal computer 14, non-gradation image data such as characters are inputted to image processing means 13 from data file of an external memory unit such as a magnetic tape 15, a floppy disk 16, a compact disk 17, etc. The gradation image and the non -gradation image correspond to each other on said processing means 13, and said two images are laid out to determine an arrangement. Data of the two images corresponded or laid out are prepared and are filed in the external memory unit 15, 16 or 17.

Next, image forming means 18 connected to said image processing means 13 is operated by a personal computer 14, and an image is formed on a paper mount 19 supplied to the image forming means 18, and a visiting card 20 is prepared.

The above image forming means 18 comprises a printer of sublimation transfer type as a main unit, and further contains a dye receiving layer transfer means, and when necessary, a non-gradation image forming means such as a thermal transfer printer of heat fusion type, a laser printer, an ink jet printer, a dot impact printer or a pen plotter. (In the following, the thermal transfer printer of heat fusion type is described as an example.)

Figure 3:
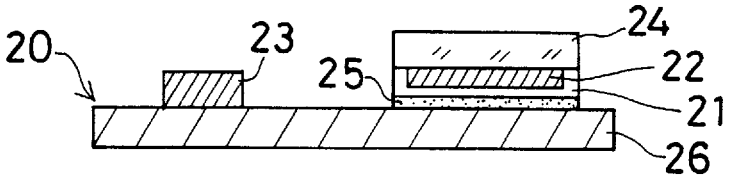
FIG. 3 is a drawing of a cross-section of a visiting card prepared according to the invention.

First, based on the data from said image processing means 13, a dye receiving layer 21 is transferred from a receiving layer thermal transfer sheet to a gradation image forming area of a paper mount 26 as shown in FIG. 3, and a gradation image 22 such as a photograph of face is transferred on surface of the receiving layer 21 by sublimation transfer method. In this case, a non-gradation image 23 such as character combined with the gradation image before and after the formation of the gradation image is printed by an arbitrary non-gradation image forming means as described above. This non-gradation image 23 may be printed in advance on a paper mount by an arbitrary non-gradation image forming means as described above. In this case, there is no need to provide non-gradation image forming means to the image forming means 18.

Thus, a visiting card 20 with a desired gradation image can be prepared. To protect the image, a protective layer 24 may be formed on surface of an image 22 and/or an image 23 by incorporating protective layer transfer means in the image forming means 18.

Figure 4:
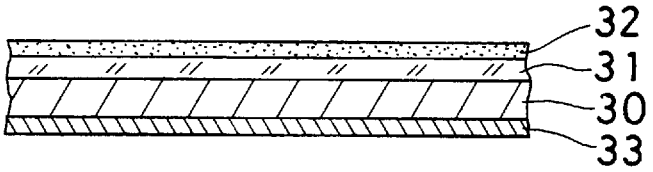
FIG. 4 is a drawing for explaining a cross-section of a receiving layer transfer sheet.

As shown by the cross-section of FIG. 4, in a receiving layer transfer method to be used in the image forming means 18, a resin layer 31 stainable by sublimation dye such as polyester resin or a polyvinyl chloride-polyvinyl acetate copolymer is formed on one side of a film 30 of a base material such as polyester film, polyimide film, etc., and an adhesive layer 32 containing an adhesive agent such as a polyvinyl chloride-polyvinyl acetate copolymer, acrylic resin, polyamide, etc. is formed on the above resin layer. On the opposite side, a transfer sheet with a heat-resistant smooth layer 33 is used when necessary, and, by placing it on the surface of the paper mount and by heating and pressing by thermal head, hot stamper, heat roll, etc. from the back surface, the dye receiving layer (21 and 25 in FIG. 3) can be transferred only to a desired area of the paper mount made of plain paper. Such receiving layer transfer method is described in detail in the specifications of prior applications by the present applicant (Japanese Provisional Patent Publications No. 64-87390, No. 64-72893 and No. 1-16068).

Figure 5:
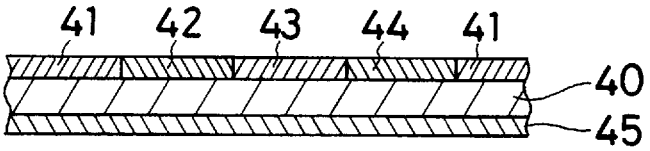
FIG. 5 is a drawing for explaining a sublimation type thermal transfer sheet.

As shown in FIG. 5, the sublimation transfer method is such that sublimation dye of yellow 41, magenta 42 and cyan 43, and of black 44 when necessary, is applied by a binder on one side of a base material film 40, and a heat-resistant smooth layer 45 is provided on the back surface as necessary. By printing with thermal head of a printer, a gradation type full-color image 22 as desired with any density can be formed in the receiving layer 21. (See FIG. 3.)

Figure 6:
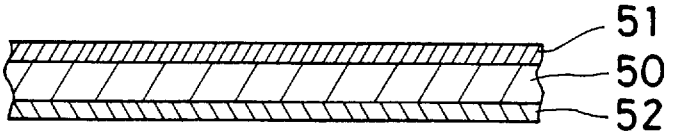
FIG. 6 is a drawing for explaining a cross-section of a heat fusion type transfer sheet.

The heat fusion type transfer method to be used in the present invention when necessary is as shown in FIG. 6. In this method, an ink layer 51 containing wax and pigment molten by heat of the thermal head and transfer on paper is provided on one side of the base material film 50, and a heat-resistant smooth layer 52 is furnished on the back surface as necessary. By printing with thermal head of the printer, a non-gradation image with high density such as characters, symbols, etc. can be obtained. The transfer method itself has been known in the past, and it can be used in the present invention.

Figure 7:
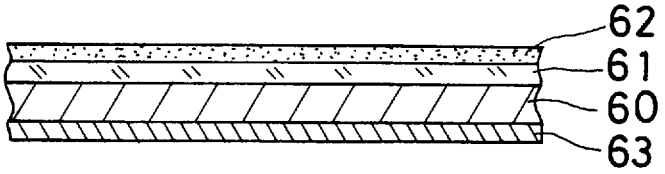
FIG. 7 is an illustrative drawing of a cross-section of a protective layer transfer sheet.

In the protective layer transfer method to be used in the present invention when necessary, of which a cross-section is shown in FIG. 7, a transparent resin layer 61 with high durability such as polyester resin, acrylic resin, etc. is formed on one surface of a base material film 60 such as polyester film, polyimide film, etc. An adhesive layer 62 containing an adhesive agent such as a polyvinyl chloride-polyvinyl acetate copolymer, acrylic resin, polyamide, etc. is formed on the above resin layer. On the opposite side, a transfer sheet having a heat-resistant smooth layer 63 on the opposite side is used, and this is placed on the surface of the image on the paper mount. By heating and pressing by thermal head, hot stamper, heat roll, etc. from the back surface, a protective layer can be transferred only to a desired area of the image (24 of FIG. 3). Such protective layer transfer method itself is described in the specifications of the prior applications by the present applicant as described above.

The above transfer sheet may be such that two types or more of the dye receiving layer, the dye layer, the ink layer, and the protective layer are sequentially provided on the same base material film surface. In such case, the structure of the printer may be simplified.

Concrete description is now given on the features of the present invention in connection with the embodiments. In the following, "part" or "%" is based on weight unless otherwise stated.

Example 1

On surface of a polyethylene terephthalate film (#25; Toray Industries, Inc.) having a heat-resistant smooth layer on its back side, a coating solution for forming a receiving layer with the following composition was coated by a bar coater to have a coating of 5.0 g/m$^2$ when dried with width of 30 mm and spacing of 120 mm. Further, a coating solution for forming an adhesive layer as described below was coated to have a coating of 2.0 g/m$^2$ when dried, and this was dried to form a receiving layer.

Composition of coating solution for receiving layer:

| | |
|---|---|
| Polyvinyl chloride-polyvinyl acetate copolymer (1000AS; Denki Kagaku Kogyo K.K.) | 100 parts |
| Amino denatured silicone (X-22-343; Shin-Etsu Chemical Co., Ltd.) | 5 parts |
| Epoxy denatured silicone (KF-393; Shin-Etsu Chemical Co., Ltd.) | 5 parts |
| Methylethylketone/toluene (weight ratio: 1/1) | 500 parts |

Composition of coating solution for adhesive layer:

| | |
|---|---|
| Ethylene-vinyl acetate copolymer heat sealer (AD-37P295; Toyo Morton Co., Ltd.) | 100 parts |
| Pure water | 100 parts |

On a non-coated area of the above polyester film, ink of yellow, magenta and cyan as described below was repeatedly coated with width of 30 mm and spacing of 60 mm to have a coating of about 3 g/m$^2$ when dried. After drying, a sublimation dye layer was obtained.

Yellow ink

| | |
|---|---|
| Disperse dye (Macrolex Yellow 6G; Bayer AG; C.I. Disperse Yellow 201) | 5.5 parts |
| Polyvinyl butyral resin (Eslek BX-1; Sekisui Chemical Co., Ltd.) | 4.5 parts |
| Methylethylketone/toluene (weight ratio: 1/1) | 89.0 parts |

Magenta ink

The same as in the case of yellow ink, except that magenta disperse dye (C.I. Disperse Red 60) was used as dye.

Cyan ink

The same as in the case of yellow ink, except that cyan disperse dye (C.I. Solvent Blue 63) was used as dye.

Next, on a non-coated surface of the same polyester film, ink for forming a protective layer with the following composition was coated by gravure coating method to have a coating of 5 g/m$^2$ in solid standard with width of 30 mm and spacing of 120 mm and was dried. Further, the following ink for an adhesive layer was coated to have a coating of 1 g/m$^2$ at solid standard and was dried to form a protective layer. A receiving layer, a dye layer and a protective layer were sequentially formed to prepare a thermal transfer sheet.

Next, on the surface of polyester film similar to the above, ink for a detachment layer with the following composition was coated by gravure coating method to have a coating of 1 g/m$^2$ at solid standard and was dried to form a detachment layer.

Ink for detachment layer

| | |
|---|---|
| Acrylic resin | 20 parts |
| Methylethylketone | 100 parts |
| Toluene | 100 parts |

Next, the following ink was coated on the surface of the above detachment layer by gravure coating method to have a coating of 3 g/m$^2$ and was dried to form a heat fusion type ink layer, and heat fusion type thermal transfer sheet was prepared.

Heat fusion type ink

| | |
|---|---|
| Acryl/vinyl chloride/polyvinyl acetate copolymer type resin | 20 parts |
| Carbon black | 10 parts |
| Toluene | 35 parts |
| Methylethylketone | 35 parts |

Combining a CCD scanner (trade name GT-6000; Epson Co., Ltd.) with a personal computer (trade name PC-9801; NEC Corporation), a sublimation transfer printer (trade name VY-100; Hitachi, Ltd.) and a heat fusion printer (trade name X-22; Okabe Marking System Co., Ltd.), a 3-color separation signal of face photograph by CCD scanner was reproduced on an image processing unit. Character information such as company name, address, telephone number, etc. filed in floppy disk was called and combined, and this was laid out within a frame on a visiting card.

Then, a receiving layer of 15 mm square was transferred to a corner left above on a paper mount of the visiting card using a printer provided with the above composite heat transfer sheet. Next, a full-color face photograph was transferred on the receiving layer by the dye layer, and a protective layer was transferred on the surface. Further, a character image of the visiting card was printed on the remaining space using a printer provided with the above heat fusion thermal transfer sheet, and a visiting card with a face photograph was prepared.

As described above, visiting cards with gradation image such as face photograph can be prepared by a simple unit and in small lot. In the above embodiment, description has been given on visiting cards as an example, while the method is useful for preparing various types of greeting cards such as post cards or identification cards.

Figure 8:
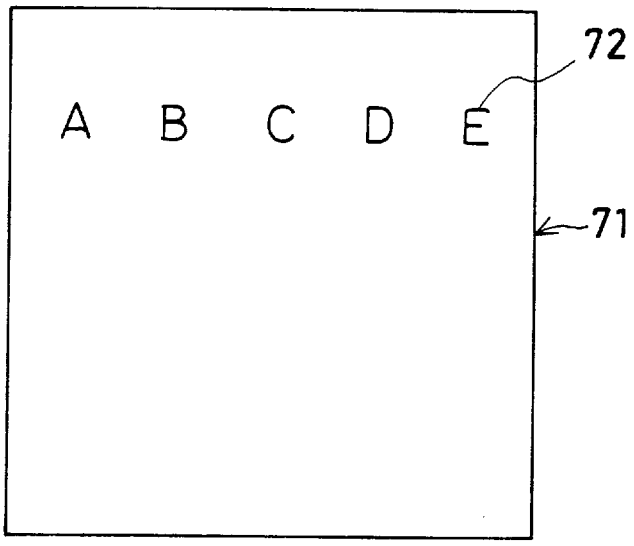
FIG. 8 is a drawing of plain paper where wax images are formed.
Figure 9:
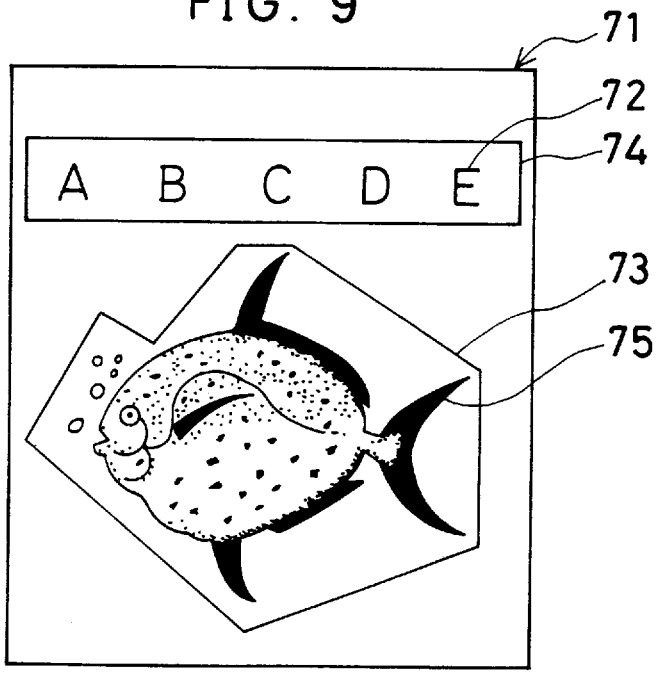
FIG. 9 is a drawing of a gradation image transferred on the plain paper of FIG. 8.

Next, description is given on the case where a dye image and a wax image are formed on plain paper without increasing the number of processes, referring FIG. 8 and FIG. 9.

As shown in FIG. 8, a wax image 72 is formed on plain paper 71 by a heat fusion type transfer sheet. Next, a receiving layer 73 having similar shape as a gradation image is transferred to an area where gradation image is to be formed, and similar receiving layer 74 is transferred and formed on the surface where the above wax image 72 has been formed. Because this receiving layer 74 is formed of colorless, transparent resin with high durability, it functions as a dye receiving layer to the dye image, while it works as a protective layer to the wax image 72.

After a gradation image (dye image) such as a face photograph has been formed on the receiving layer, the receiving layer may be transferred on the image. In this case, stainable resin is used as the receiving layer resin, i.g. polyester resin, polyvinyl chloride acetate resin, styrene resin, vinyl chloride resin, polyvinyl acetate resin, polycarbonate resin, etc. Further, a mold releasing agent of silicone type, fluorine type, etc. may be contained in the receiving layer. Also, an adhesive layer may be provided on the receiving layer which is transferred on the image. As such adhesive layer, there are resins such as acryl, polyvinyl chloride acetate, polyester, polyamide, urethane, etc. In the transfer of the receiving layer in this case, the receiving layer is partially transferred, and the receiving layer of the next image may be used, or a transfer sheet may be used, which has the receiving layer twice as long as the dye layer (in flowing direction).

Then, as shown in FIG. 9, by transferring the gradation image (dye image) 75 such as face photograph on the receiving layer 73, a print having a wax image 72 and a dye image 75 in mixed state and with high durability can be obtained without forming a protective layer for protecting a wax image 72 by separate process.

As the paper to be used for this purpose, there is no restriction, and plain paper such as visiting card, post card, paper for notebook, paper for report, PPC paper, etc. may be used.

Example 2

On the surface of polyethylene terephthalate film (#25; Toray Industries, Inc.) having a heat-resistant smooth layer on its back side, a coating solution for forming receiving layer with the following composition was coated by a bar coater to have a coating of 5.0 g/m$^2$ when dried and with width of 30 mm and spacing of 120 mm. Further, a coating solution for forming adhesive layer as described below was coated on it by the same procedure to have a coating of 2.0 g/m$^2$ when dried and was dried to form a receiving layer.

Composition of coating solution for receiving layer:

| | |
|---|---|
| Polymethyl metacrylate (BR-85PMMA; Mitsubishi Rayon Co., Ltd; 1000AS) | 100 parts |
| Amino denatured silicone (X-22-343; Shin-Etsu Chemical Co., Ltd.) | 5 parts |
| Epoxy denatured silicone (KF-393; Shin-Etsu Chemical Co., Ltd.) | 5 parts |
| Methylethylketone/Toluene (Weight ratio: 1/1) | 500 parts |

Composition of coating solution for adhesive layer

| | |
|---|---|
| Ethylene-polyvinyl acetate copolymer resin type heat sealing agent (Toyo Morton Co., ltd.; AD-37P295) | 100 parts |
| Pure water | 100 parts |

On the non-coated area of the above polyester film, ink of yellow, magenta and cyan was coated sequentially by the same procedure as in the Example 1 to have a coating of about 3 g/m$^2$ when dried and with width of 30 mm and spacing of 30 mm and was dried to prepare a 3-color sublimation dye layer.

Next, on the surface of the same polyester film as above, the same ink for detachment layer as in the Example 1 was coated by gravure coating method to have a coating of 1 g/m$^2$ in solid standard and was dried to prepare a detachment layer.

Then, using the same heat fusion type ink as in the Example 1, a thermal transfer sheet of heat fusion type was prepared by the same procedure, and layout was performed in a frame on a visiting card by the same apparatus.

Next, a wax image such as characters, symbols, etc. as desired was prepared by a printer having a heat fusion type thermal transfer sheet, and a receiving layer was transferred on a wax image and other desired area. Then, a full-color face photograph was transferred on the receiving layer of the other area by the dye layer to prepare a visiting card with a face photograph.

When a patch of gauze was pressed closely on the visiting card thus prepared and was rubbed, but none of the images was stained or deteriorated.

In contrast, in case of a print, for which the receiving layer was not transferred on the wax images by the above method, the wave images collapsed when rubbed with the same gauze and the area around the characters was stained in black.

Thus, by forming wax images on the surface of plain paper and by forming the receiving layer for forming a dye image on the surface of the wax images, a print can be easily obtained, where wax image and dye image with high durability coexist without increasing the number of processes.

Figure 10:
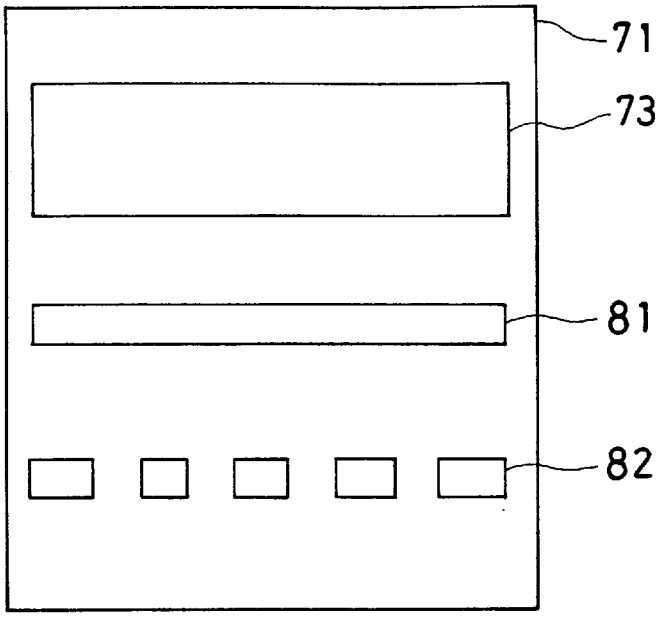
FIG. 10 and FIG. 11 show embodiments where a receiving layer is transferred by blocks on plain paper.
Figure 11:
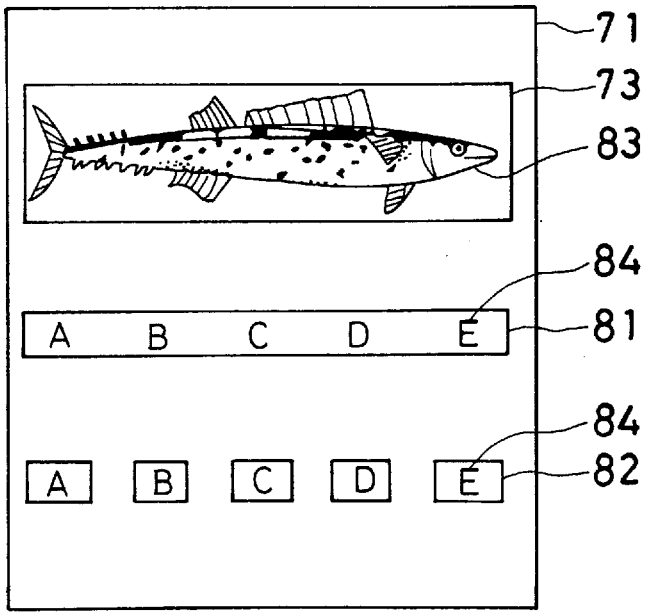
Figure 12:
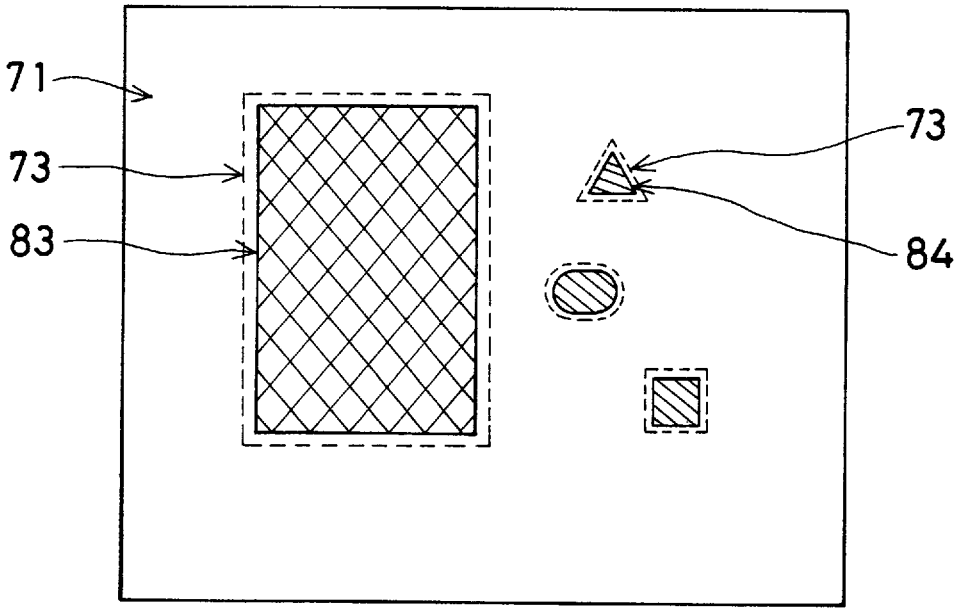
FIG. 12 shows an embodiment of the present invention where a receiving layer area and an image area precisely correspond to each other.

Next, referring to FIG. 10 and FIG. 11, description is given on the case where a gradation image and/or characters, symbols, etc. can be obtained without losing smoothness, texture feeling and writability of plain paper.

As shown in FIG. 10, a receiving layer 73 is transferred by block in similar shape as said gradation image in an area 72 where a gradation image of plain paper 71 is to be formed. On the other hand, in the area where characters, symbols, etc. are to be formed, receiving layers 81 and 82 are formed in form of stripe 81, rectangles 82 or of the same contour as characters, symbols, etc. (not shown) within an area to accommodate said characters and symbols.

Next, as shown in FIG. 11, a gradation image 83 such as face photograph is formed by transfer on the above receiving layer 73, and characters and symbols 84 are formed by transfer on the receiving layers 81 and 82 by sublimation transfer method. In so doing, the area other than the image forming area remains in a state of plain paper, and smoothness, texture feeling and writability of plain paper can be maintained.

Example 3

By the same procedure as in the Example 2, layout was performed in a frame of plain paper of B5 size, and a receiving layer of 15 mm square was formed by transfer in an area left above of plain paper by a printer with a composite thermal transfer sheet, and rectangles of the same size as characters were formed by transfer on the area where character image is to be formed. Then, a full-color face photograph and characters were formed by transfer with the dye layer, and a protective layer was transferred on the surface of these images.

The face photograph and the characters of the print thus obtained show fresh and high gradation, while it has the same smoothness, texture feeling as plain paper, and it is possible to write on the remaining area by pencil, fountain pen, etc.

Further, referring to FIG. 12 to FIG. 15, description is given on a case where texture feeling as plain paper is improved.

Figure 13:
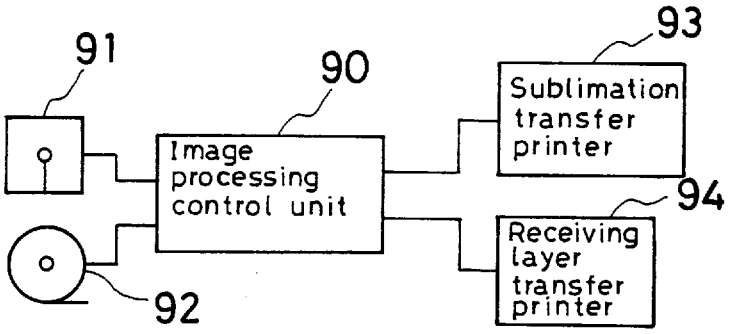
FIGS. 13(*a*) and 13(*b*) are block diagrams of an image recording apparatus for the image recording of FIG. 12.
Figure 13B:
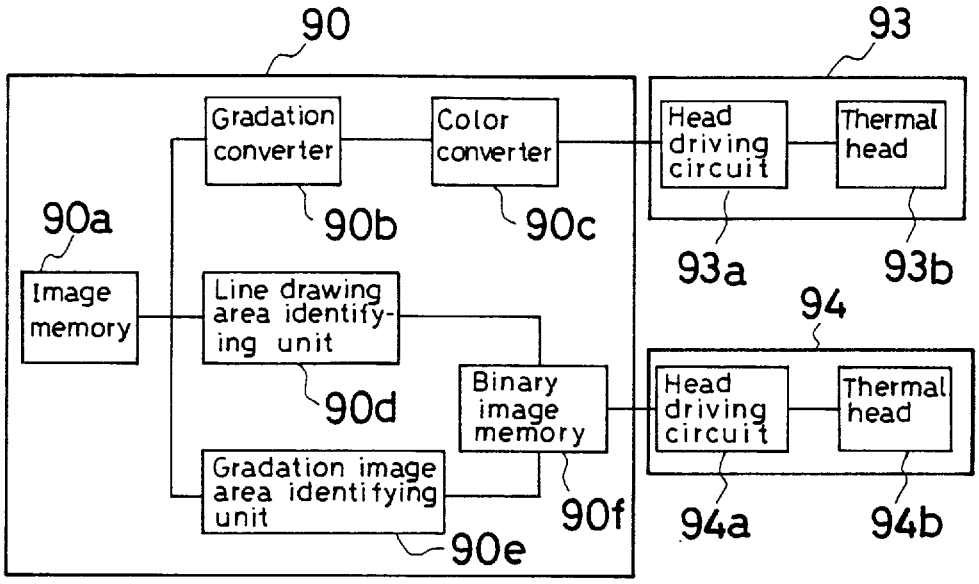

As shown in FIG. 13 (*a*), image data recorded in a floppy disk 91, magnetic tape 92, etc. are read by an image processing control unit 90, and an area where An image is to be formed is identified by the image processing control unit 90. The image processing control unit 90 drives a receiving layer transfer printer 94 to the identified area, transfers the receiving layer, and outputs image data to a sublimation transfer printer 93. Thus, an image is formed on an area 72 where the receiving layer has been formed.

The image processing control unit 90 is given by a functional block diagram of FIG. 13 (*b*) and detects an area where line drawing or gradation image is formed from the image data read in an image memory 90*a* incorporated in the image processing control unit 90 by a line drawing area identifying unit 90*d* and a gradation image area identifying unit 90*e*. Contour data obtained by edge detection of the area where image data are present are stored in memory in a binary image memory 90*f* as image forming area data (binary data) Based on the image forming area data, a head driving circuit 94*a* of the receiving layer transfer printer 94 is driven, and by turning thermal head 94*b* on, the receiving layer is transferred to the gradation image recording area and the line drawing graphics recording area on plain paper 71 of FIG. 12. In this case, an edge of the receiving layer transfer area 72 is brought at least by 1 dot or more outside the image area edge in order to prevent image disturbance in the image area edge.

The image processing control unit 90 converts the image data to density data by a gradation converter 90*b* and generates color data by a color converter 90*c*. Driving a head driving circuit 93*a* of the sublimation transfer printer 93 and by turning a thermal head 93*b* on, a gradation image 83 or a line drawing graphic 84 is recorded on the receiving layer area 72.

Because the receiving layer area 72 is formed only in the gradation image forming area 83 and the line drawing graphic area 84, texture and touch feelings as plain paper are maintained in the other area, and the image is formed in the receiving layer area 72. Accordingly, the receiving layer does not become conspicuous, and it appears as if the image has been recorded on plain paper.

The formation of the receiving layer is not limited to an image portion, and it is also possible to form the receiving layer in an area having a certain level of printing or on an entire column of characters.

Figure 14A:
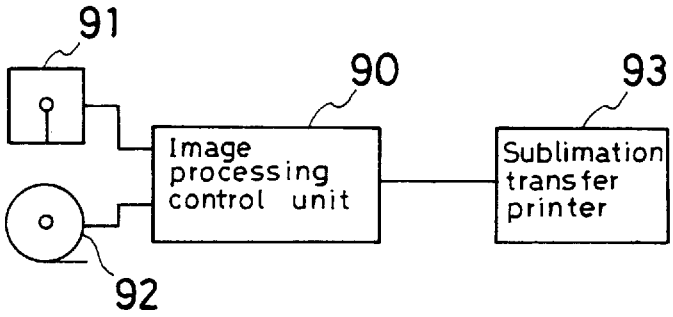
FIGS. 14(*a*) and 14(*b*) are block diagrams of another image recording apparatus for the image recording of FIG. 12.
Figure 14B:
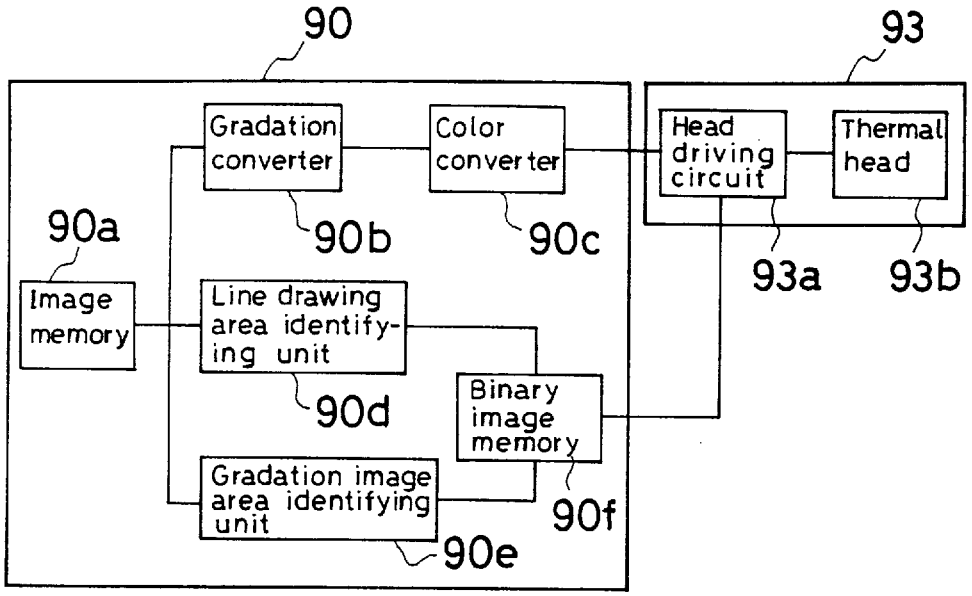
Figure 15:
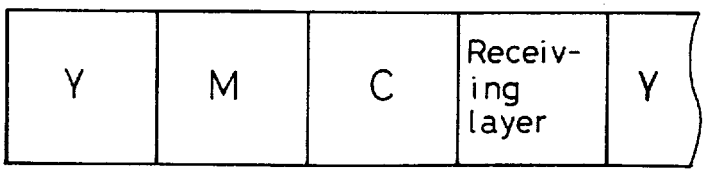
FIG. 15 represents an arrangement of a transfer film.

FIGS. 14(*a*), 14(*b*) and FIG. 15 show the cases where only a sublimation transfer printer is used.

In FIGS. 14(*a*) and 14(*b*) a sublimation transfer printer 93 is also used as a receiving layer transfer printer, and it differs from the case of FIGS. 13(*a*) and 13(*b*) in that not only the image but also the receiving layer is transferred by the sublimation transfer printer 93. Specifically, the sublimation transfer printer of FIG. 14 (*a*) forms the receiving layer in an area other than 3-color area of Y, M and C on a transfer film as shown in FIG. 15. Based on the image forming area data generated in a binary image memory 90*f* as shown in FIG. 14 (*b*), a head driving circuit 93*a* is driven and a thermal head 93*b* is turned on to form a receiving layer, and an image is formed on this receiving layer forming area.

According to this example, there is no need to provide a special-purpose printer for forming the receiving layer, and the receiving layer can be transferred and the image can be formed by a single sublimation transfer printer. Thus, the apparatus arrangement can be simplified.

As described above, the receiving layer is formed on a minimum area on a member to be recorded according to the information of an image to be formed. This makes it possible to maintain texture and touch feelings and writability of plain paper on the member to be recorded.

Figure 16:
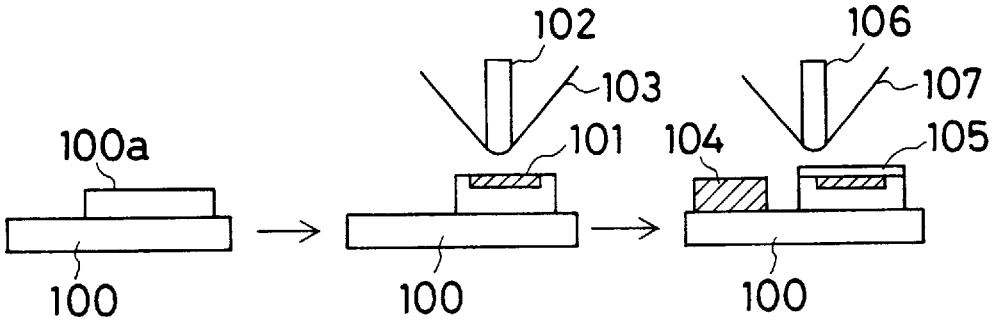
FIG. 16 and FIG. 17 show transfer of a protective layer and a character image by 2 heads.
Figure 17:
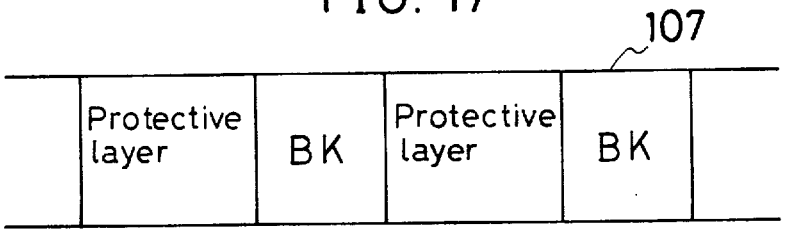

To form a protective layer on non-gradation image when necessary in addition to the formation of gradation image and non-gradation image, it is preferable to perform as follows:

As shown in FIG. 16, a gradation image 101 is formed by transfer from a dye transfer film 103 to a dye image receiving sheet 100 where a receiving layer 100*a* is formed in advance by driving a thermal head 102. Then, driving a thermal head 106 and by heating and pressing a fusion-protective layer integrated film 107, a non-gradation image 104 is formed by transfer, and a transparent protective layer 105 is formed on the gradation image. As the fusion-protective layer integrated film 107, a transparent protective layer and Bk (black) are sequentially formed as shown in FIG. 17 and used.

Figure 18:
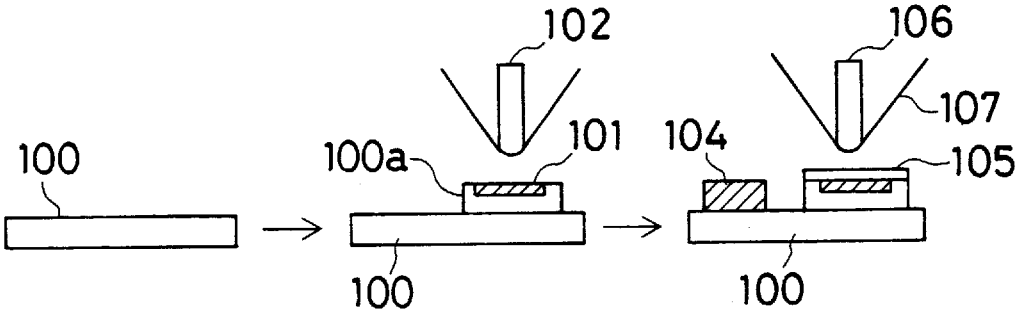
FIG. 18 and FIG. 19 show transfer of a receiving layer and a 3-color image by 2 heads.
Figure 19:
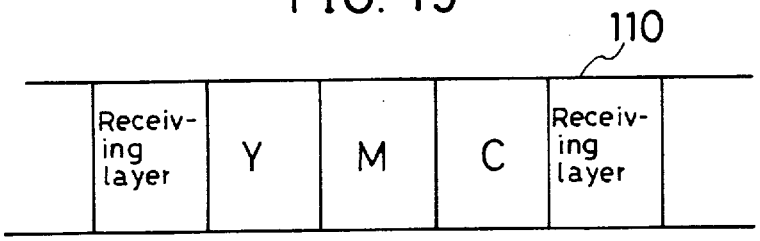

Also, using a receiving layer-dye layer integrated film 110 where a receiving layer and Y, M and C are sequentially formed as shown in FIG. 19, and a receiving layer 1000*a* and a gradation image 101 are formed by transfer on a base material 100 by a thermal head 102 as shown in FIG. 18. Then, by heating and pressing the fusion-protective layer integrated film 107 by thermal head 106, a non-gradation image 104 is formed by transfer, and a transparent protective layer 105 is formed on the gradation image.

As described above, the gradation image and the non-gradation image are formed by two heads, and a protective layer can be formed on the gradation image. This protective layer has functions such as mold releasing function, security function, ultraviolet ray shielding function, chemical resistant function, etc. and can be applied for each different purpose.

Next, description is given on a case where the present invention is applied on a booklet.

Figure 20:
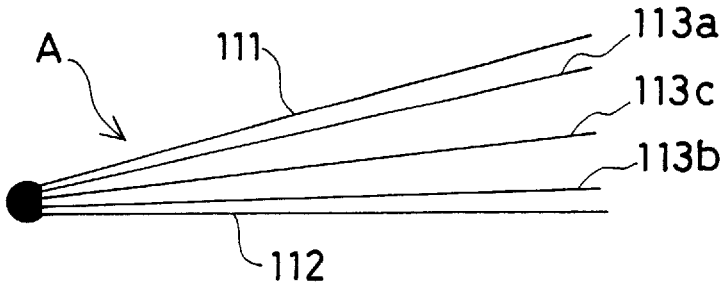
FIG. 20 is a side view illustrating a booklet according to present invention.

As shown in FIG. 20, a preferred example of a booklet A of the present invention comprises a front cover 111, a back cover 112 and one or more paper mounts 113*a*, 113*b*, 113*c*, . . . fastened between the two covers, and it is characterized in that a dye receiving layer for accommodating sublimation dye is provided at least on a part of the front cover, the back cover or the paper mounts.

Figure 21:
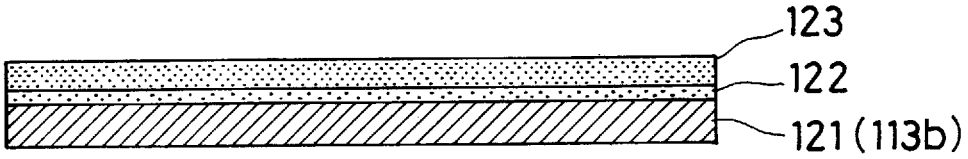
FIG. 21 is a cross-sectional view of a paper mount provided with a dye receiving layer.

FIG. 21 is a cross-sectional view of a paper mount where the above dye receiving layer is furnished, and the dye receiving layer 123 is formed at least on one side of the paper mounts 121 (113*b*) as necessary through an intermediate layer 122 such as a filling layer, an adhesive layer and a cushion layer. These paper mounts may be transparent.

In the above arrangement, the booklet A is a conventional type booklet such as passport, pocketbook, etc., and there is no restriction on applications, shape, etc. of the booklet, and the booklet is made of various types of paper such as PPC paper, thermal transfer paper, wood-free paper, art paper, coated paper, cast-coated paper, Kent paper, synthetic paper, plastic film or other laminations.

The dye receiving layer 123 formed on the surface of the paper mount 121 accommodates the sublimation dye shifted from the thermal transfer sheet and maintains an image. To form the intermediate layer 122 and the dye receiving layer 123 on the paper mount 121, a coating method as used in the past may be employed, or a receiving layer transfer method may be used.

As a resin to form the dye receiving layer, there are polyolefine type resin such as polypropylene, halogenated polymer such as polyvinyl chloride, polyvinylidene chloride, etc., polyvinyl polymer such as polyvinyl acetate, polyacryl ester, polyvinyl chloride-polyvinyl acetate copolymer, etc., polyester type resin such as polyethylene terephthalate, polybutyrene terephthalate, etc., copolymer type resin such as polystyrene type resin, polyamide type resin, copolymer type resin of olefine such as ethylene, propylene, etc. with the other polyvinyl monomer, cellulose type resin such as ionomer, cellulose diacetate, etc., polycarbonate, etc. It is preferable to use polyvinyl type resin and polyester type resin. The dye receiving layer to be formed may be in any thickness, while it is generally 1–20 μm thick.

Figure 22:
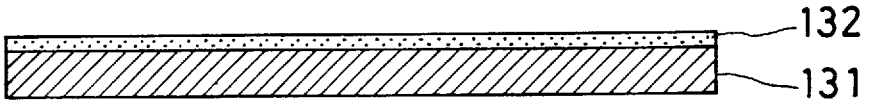
FIG. 22 is a cross-sectional view of a laminate for image protection.

In a preferred embodiment of the invention, a laminate sheet for image protection (or a protective layer transfer sheet) 113*c* is fastened on the above paper mount 113*b* on the side where the dye receiving layer is provided as shown in FIG. 20. As a cross-section illustratively given in FIG. 22, the laminate sheet for image protection is in such arrangement that a heat-sensitive adhesive layer (or a sticky adhesive layer) 132 is provided on one side of a plastic sheet 131 having high transparent property such as polyester, polypropylene, etc.

Figure 23:
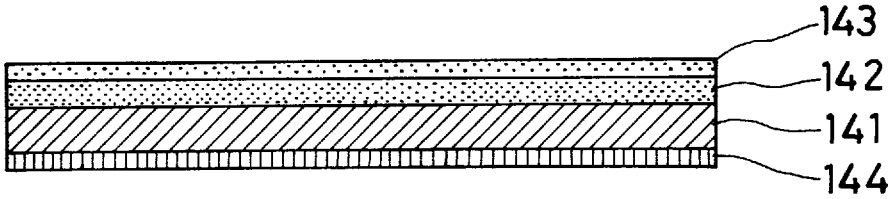
FIG. 23 is a cross-sectional view of a protective layer transfer sheet.

The above protective layer transfer sheet 113*c* has such arrangement as shown in FIG. 23, that a resin layer 142 having excellent transparent property and durability such as polyester resin, acrylic resin, etc. on one side of a base film 141 such as polyester film, polyimide film, etc., an adhesive layer 143, comprising an adhesive such as polyvinyl chloride-polyvinyl acetate copolymer, acrylic resin, polyamide, etc. is formed on it, and a heat-resistant smooth layer 144 is provided on the opposite side as necessary.

Figure 24:
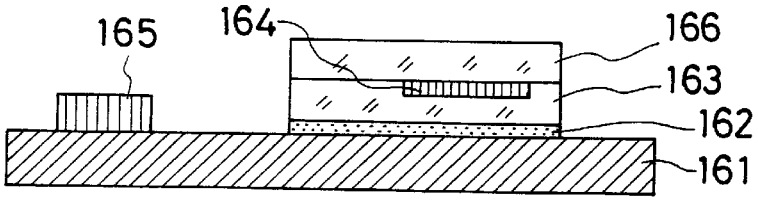
FIG. 24 is a drawing for illustrating a formed image.

As shown in FIG. 24, a gradation image 164 such as face photograph is formed by transfer on the surface of the receiving layer 163 of a gradation image forming area of a paper mount 161 of a booklet by sublimation transfer method. In this case, a non-gradation image 165 such as character combined with the gradation image is printed before and after the formation of the gradation image. This non-gradation image 165 may be printed on the paper mount in advance.

A booklet 150 with a desired gradation image is prepared as described above, and a protective layer 166 can be formed on the surface of the gradation image 164 and/or the non-gradation image 165 by a laminate sheet or a protective layer transfer sheet in order to protect these images.

In another embodiment of the invention, a booklet for forming an image comprises a front cover, a back cover and one or more paper mounts fastened therebetween, and a dye receiving layer is transferred at least on a part of the front cover, the back cover or the paper mounts, and an image can be formed on said dye receiving layer by thermal transfer method.

Figure 25:
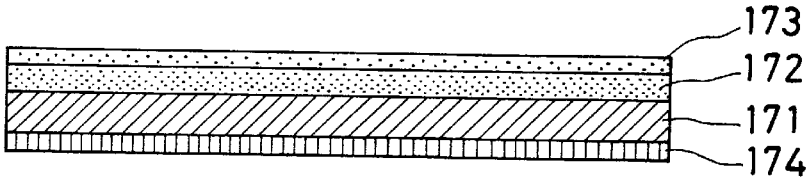
FIG. 25 is a cross-sectional view of a receiving layer transfer sheet.

The booklet itself is the same as in the conventional technique. In a dye receiving layer transfer sheet where the dye receiving layer is transferred at least to a part of a booklet with a cross-section as shown in FIG. 25, a resin 172 stainable by sublimation dye such as polyester resin, or polyvinyl chloride-polyvinyl acetate copolymer is formed on one side of a base material film 171 such as polyester film, polyimide film, etc., and an adhesive layer 173 containing an adhesive agent such as polyvinyl chloride-polyvinyl acetate copolymer, acrylic resin, polyamide, etc. is formed on it, and a heat-resistant smooth layer 174 is formed on the opposite side as necessary. In this case, a mold release layer may be provided between the receiving layer resin and the base material. As the mold release resin, there are water-soluble resin such as PVC, aqueous polyester, polyurethane, polyamide, polyethyleneglycol, nitrocellulose, etc. This is placed on the surface of the paper mount as given in FIG. 24. By heating and pressing it from back side using thermal head, hot stamper, heat roll, etc., a dye receiving layer 163 can be transferred only to a desired area of the paper mount through an adhesive layer 162.

Then, an image 164 is formed by sublimation transfer method as described above. In a preferred aspect of the embodiment, a laminate sheet may be laminated for the protection of the image 164 or a protective layer 166 is transferred by the protective layer transfer sheet.

Figure 26:
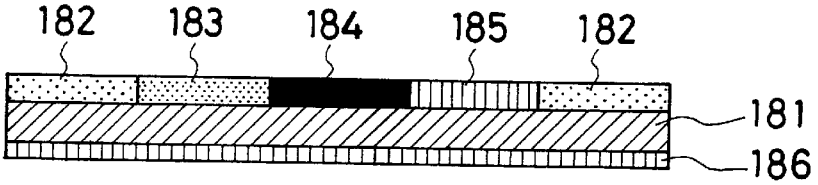
FIG. 26 is a cross-sectional view of a sublimation type transfer sheet.

In the sublimation transfer method, a sublimation dye of yellow 182, magenta 183 and cyan 184, and further black 185 when necessary, is carried by a binder on one side of a base material film 181 as shown in FIG. 26, and a heat-resistant smooth layer 186 is provided on the opposite side when necessary. By printing with a thermal head of a printer, a full-color image 164 of any gradation and density can be formed in the receiving layer 163. (See FIG. 24.)

Figure 27:
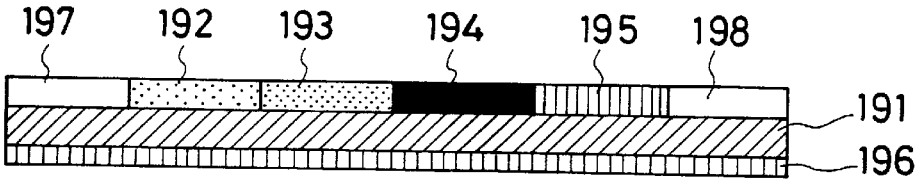
FIG. 27 is a cross-sectional view of a one-stage type composite thermal transfer sheet.

In a method for sequentially transferring the dye receiving layer and the image, the above receiving layer transfer sheet and the above thermal transfer sheet may be used. Also, it is possible as shown in FIG. 27 to form consecutively a dye receiving layer, a dye image, a protective layer and a non-gradation image using an integrated type composite thermal transfer sheet provided with a transfer type dye receiving layer 197 as shown in FIG. 25, and further, a transfer type protective layer 198 of FIG. 23, on one side of a base material film 191, in addition to the dye layers of yellow 192, magenta 193 and cyan 194, and further black 195 as necessary. As the result, the printer structure can be more simplified.

Figure 28:
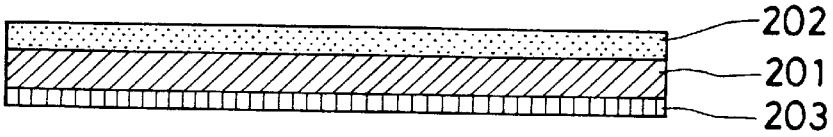
FIG. 28 is a cross-sectional view of a heat fusion type thermal transfer sheet.

In a heat fusion type transfer method to be used when necessary, an ink layer 202 comprising wax and pigment melted by heat of a thermal head and transferred to paper is provided on one side of a base material film 201 as shown in FIG. 28, and a heat-resistant smooth layer 203 is furnished on back side when necessary. By printing with a thermal head of a printer, a non-gradation image with high density such as characters, symbols, etc. can be formed.

In another aspect of the embodiment of the invention, an image sheet containing sublimation dye may be fastened or attached in advance in a booklet for image formation, which comprises a front cover, a back cover and one or more paper mounts fastened therebetween.

In still another aspect of the invention, an image by sublimation dye may be formed at least a part of a booklet for image formation, which comprises a front cover, a back cover and one or more paper mounts fastened therebetween.

Example 4

A coating solution for a receiving layer having the same composition as in the Example 1 was coated on the surface of plain paper by a bar coater to have a coating of 5.0 g/m$^2$ when dried and was dried to prepare an image receiving sheet. This was cut into pieces of adequate size and these were fastened in a passport to prepare a booklet.

Example 5

On the surface of a polyethylene terephthalate film (#25; Toray Industries, Inc.) having a heat-resistant smooth layer on its back side and its front side processed by detaching treatment, an ink for protective layer with the following composition was coated by gravure coating method to have a coating of 5 g/m$^2$ on solid standard and was dried. Thus, a protective layer was formed and a protective layer thermal transfer sheet was prepared.

Ink for protective layer

| | |
|---|---|
| Polyester type resin | 20 parts |
| Methylethylketone | 100 parts |
| Toluene | 100 parts |

After this was cut into pieces of adequate size, these were placed on the image receiving sheet of the Example 4, and were fastened on a passport to prepare a booklet.

Example 6

Yellow, magenta and cyan ink of the same composition as in the Example 1 was sequentially coated with width of 30 mm to have a coating of about 3 g/m$^2$ when dried and was dried. Thus, a 3-color sublimation dye layer was formed on the same polyester film as above, and a sublimation type thermal transfer sheet was prepared.

Example 7

On the surface of a polyethylene terephthalate film (#25; Toray Industries, Inc.) with its back surface containing a heat-resistant smooth layer, and its front side with detachment processing, a coating solution for forming receiving layer with the same composition as in the Example 1 was coated by a bar coater to have a coating of 5.0 g/m$^2$ when dried. Further, a coating solution for forming the following adhesive layer was coated on it to have a coating of 2.0 g/m$^2$ and was dried. Thus, a receiving layer was formed, and a receiving layer transfer sheet was prepared.

Example 8

On the surface of the same polyester film as above, a detachment layer was provided. On the surface of this detachment layer, an ink of the same composition as in the Example 1 was coated by gravure coating method to have a coating of about 3 g/m$^2$ and was dried to form a heat fusion type ink layer, and a thermal transfer sheet of heat fusion type was prepared.

Example 9

A CCD scanner (trade name GT-6000; Epson Co., Ltd.), a personal computer (trade name PC-9801; NEC Corporation), a sublimation printer (trade name VY-100; Hitachi, Ltd.), and a heat fusion type printer (trade name X-22; Okabe Marking System, Inc.) were combined. A face photograph was separated into 3 colors by CCD scanner, and signal was reproduced by an image processing unit. Character information such as company name, address, telephone number, etc. filed in a floppy disk was called, combined and laid out in a frame on a booklet of the Example 4. Next, using a printer equipped with the above sublimation type thermal transfer printer and a heat fusion type printer, a face photograph and various character information as desired were formed on an area left above of the paper mount of the booklet.

Example 10

By the same procedure as in the Example 9, a face photograph was formed on the booklet of the Example 5, and a protective layer was transferred on its surface.

Example 11

On an ordinary passport, on which a dye receiving layer is not formed, a dye receiving layer was transferred using a dye receiving layer thermal transfer sheet of the Example 7, and a face photograph was formed by the same procedure as in the Example 9. Then, a laminate sheet for protective layer was laminated by a heat roll on its surface. Further, character information was printed on a remaining blank area using a printer equipped with said heat fusion type thermal transfer sheet.

Each of the booklets prepared by the above procedure showed beautiful photographic images. Continuous image formation can be achieved. The booklet itself is not too thick, and it is impossible to correct the image or replace the image.

Example 12

On the surface of a polyester terephthalate film of 100 $\mu$m thick, a coating solution for receiving layer with the same composition as in the Example 4 was coated by a bar coater to have a coating of 5.0 g/m$^2$ when dried. After this was cut into pieces of adequate size, an image was formed by the same procedure as in the Example 6, and these were attached on the paper mounts of a passport using a heat roll to prepare a booklet.

As described above, by transferring a dye receiving layer on paper mounts in a booklet, or by fastening paper mounts having a dye receiving layer containing sublimation dye into a booklet, a gradation image such as face photograph can be formed in a booklet easily and quickly by sublimation type thermal transfer method. Because it is difficult to revise or modify the image, falsification and forging can be effectively prevented.

Next, description is given on a preferred embodiment, by which falsification and alteration can be more effectively prevented.

Figure 29:
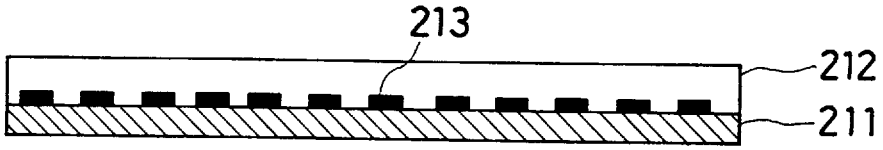
FIG. 29 is a drawing for explaining a cross-section of a thermal transfer image receiving sheet.

In this embodiment, a transparent dye receiving layer 212 is provided on a base material sheet as shown in FIG. 29, and an arbitrary pattern 213 is formed between said dye receiving layer 212 and the base material sheet 211.

The base material sheet to be used may be a sheet used as a base material in various types of cards as described above, or any base material sheet such as paper used in various types of booklets. There is to restriction to thickness of such base material sheet, but it is generally about 30–200 $\mu$m. In case the above base material sheet is poorly fitted to the dye receiving layer formed on its surface, it is preferable to perform primer treatment or corona discharge treatment on the surface.

On these base material sheets, ground patterns or other arbitrary pattern such as smaller characters, patterns, symbols, etc. are formed in advance by printing methods such as offset printing, gravure printing, screen printing, etc. or thermal transfer method, electrophotographic method, ink jet method, dot printing method, hand-writing, etc.

Figure 30:
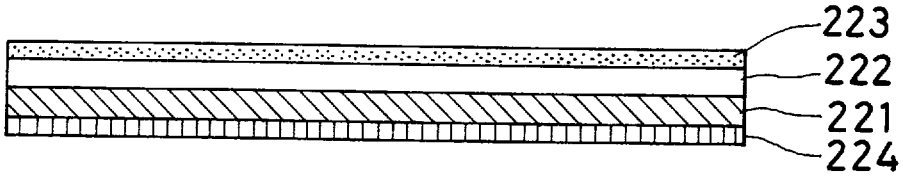
FIG. 30 is a drawing for explaining a cross-section of a receiving layer transfer film.
Figure 31:
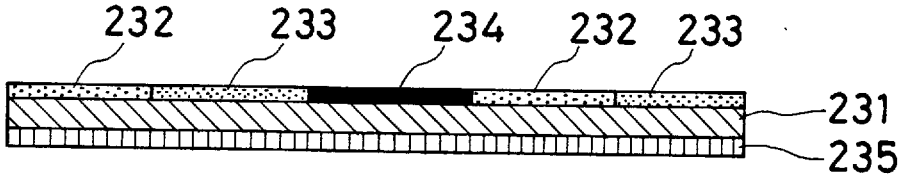
FIG. 31 is a drawing for explaining a cross-section of a dye transfer film.

In a receiving layer transfer film to be used for transferring a receiving layer, a transparent dye receiving layer 212 comprising a resin stainable by sublimation dye such as polyester resin, polyvinyl chloride-polyvinyl acetate copolymer, styrene resin, etc. is formed on one side of a base material film 221 such as polyester film, polyimide film, etc. as shown in the cross-sectional view of FIG. 30. For the purpose of providing close fitness as necessary, an adhesive layer 223 comprising an adhesive agent such as polyvinyl chloride-polyvinyl acetate copolymer, acrylic resin, polyamide resin, polyester resin, polyurethane resin, etc. is formed on it. Further, this adhesive layer may contain pigment, filler, foaming agent, etc. to give cushion property as far as transparency is not impaired. On the opposite side, a heat-resistant smooth layer 224 may be formed when necessary. By placing this on the surface of a base material sheet 251 where ground pattern 255 is formed in advance and by heating and pressing it from back side using a thermal head, a dye receiving layer 252 can be transferred only on a desired area of the base material sheet 251. The dye receiving layer to be formed may have any thickness, while it is generally 1–10 $\mu$m thick.

Figure 33:
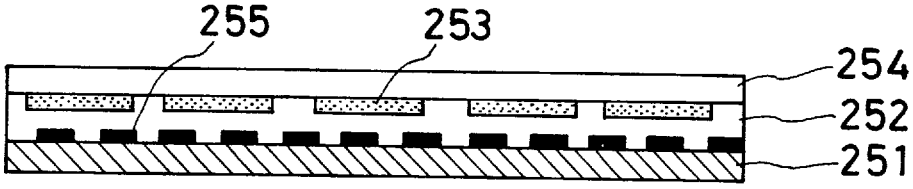
FIG. 33 is a drawing for explaining an image forming method and a printed object.

In a sublimation dye transfer film to be used for forming a dye image on a thermal transfer image receiving sheet, sublimation dye of yellow 232, magenta 233 and cyan 234, and further, black (not shown) when necessary, is carried by a binder to one side of a base material 231, and a heat-resistant smooth layer 235 is provided on the back side when necessary. By printing with a thermal head, a full-color image 253 with any density and gradation is formed in the receiving layer 252 as shown in FIG. 33.

Figure 32:
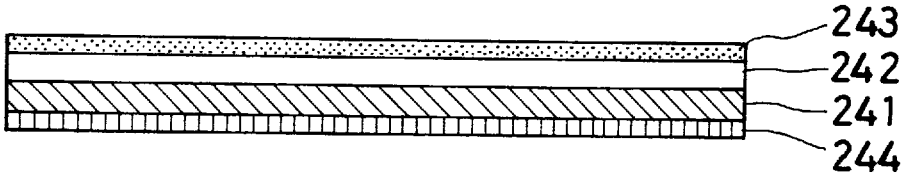
FIG. 32 is a drawing for explaining a cross-section of a protective layer transfer film.

The protective layer transfer film to be used when necessary, has the arrangement as shown in FIG. 32 and it is the same as explained in FIG. 23. As shown in FIG. 33, by placing this on an image 253 formed on the base material sheet 251, and by heating and pressing this from back side using thermal head, hot stamper, heat roll, etc., the protective layer 54 can be transferred only to the desired area of the image.

Instead of the above protective layer, a protective laminate sheet (film such as polyester film, polyvinyl chloride resin film, polycarbonate film, polypropylene film, etc. may be attached on the image surface through an adhesive layer by heat roll or thermal press lamination. In this case, the above protective layer and the laminate sheet may have an effect to shield ultraviolet ray.

Example 13

On the surface of a polyethylene terephthalate film (#25; Toray Industries, Inc.) where a heat-resistant smooth layer is formed on its backside, a coating solution for forming receiving layer with the same composition as in the Example 1 was coated by a bar coater to have a coating of 5.0 g/m$^2$ when dried. Further, a coating solution for forming an adhesive layer with the same composition as in the Example 1 was coated by the same procedure to have a coating of 2.0 g/m$^2$ when dried and was dried to prepare a dye receiving layer transfer film.

Then, the same ink of yellow, magenta and cyan as in the Example 1 was sequentially and repeatedly coated on the same polyester film as above with width of 30 mm and to have a coating of about 3 g/m$^2$ when dried and was dried. Thus, a 3-color sublimation dye layer was formed, and a sublimation dye transfer film was prepared.

Next, an ink for forming protective layer with the following composition was coated by gravure coating method on the same polyester film as above to have a coating of 5 g/m$^2$ in solid standard and was dried to form a protective layer. This was used as a protective layer transfer film.

Composition of coating solution for protective layer

| | |
|---|---|
| Acrylic resin (BR-83; Mitsubishi Rayon Co., Ltd.) | 20 parts |
| Polyethylene wax | 1 part |
| Methylethylketone/Toluene (Weight ratio: 1/1) | 80 parts |

Example 14

On a video printer (VY-200; Hitachi, Ltd.), a piece of Kent paper having ground pattern of fine characters on its surface was mounted in advance, and a receiving layer was transferred by the above dye receiving layer transfer film at first. Then, a full-color face photograph was formed by a dye transfer film. This image was clear and of high resolution as a fine pattern background. It is impossible to revise or alter the image. When another face photograph was attached, the ground pattern was covered and it looked unnatural.

Further, a protective layer was transferred on the image surface using a protective layer transfer film, and the image showed high resistance to fingerprint, anti-plasticity and abrasion resistance.

Example 15

On the surface of a polyethylene terephthalate film (#25; Toray Industries, Inc.) having a heat-resistant smooth layer on its backside, the above coating solution for forming receiving layer was coated at first by a bar coater to have a coating of 5.0 g/m$^2$ when dried and with width of 30 cm and spacing of 120 cm. Further, the above coating solution for forming adhesive layer was coated by the same procedure to have a coating of 2.0 g/m$^2$ and was dried to prepare a dye receiving layer.

Then, on a non-coated area of the above polyester film, the above ink of yellow, magenta, and cyan was coated sequentially to have a coating of about 3 g/m$^2$ when dried and with width of 30 cm and spacing of 30 cm and was dried. Thus a 3-color sublimation dye layer was formed.

Next, on a non-coated surface of the same polyester film, an ink for forming protective layer of the above composition was coated by gravure coating method to have a coating of 5 g/m$^2$ in solid standard and with width of 30 cm and spacing of 120 cm and was dried. Further, the above ink for adhesion was coated on it to have a coating of 1 g/m$^2$ in solid standard and was dried to form a protective layer. By sequentially forming a receiving layer, a dye layer and a protective layer, a composite transfer film was prepared.

Using the above composite transfer film, an image was formed by the same procedure as in the Example 14 on an ABS resin sheet for card as a base material sheet. As the result, the same excellent effect was obtained.

As described above, when a dye receiving layer is formed substantially transparent and an image is formed using a thermal transfer image receiving sheet where an arbitrary pattern (such as ground pattern) is formed between the above layer and the base material sheet, the above ground pattern provides a background for the image. Therefore, if a face photograph is attached for falsification, the ground pattern is covered in the extent of the attached face photograph, and it becomes apparent that it has been revised or falsified. Even when it is attempted to erase the image by a special chemical, the ground pattern under the image is erased at the same time, and it is impossible to restore the image to the original state.

Industrial Applicability

According to the present invention, a gradation image such as photograph and a non-gradation image such as characters, symbols, etc. are inputted, edited and laid out, and a gradation image is formed by transfer using thermal transfer method by providing a dye receiving layer in a gradation image forming area. As the result, it is possible to form a gradation image without impairing texture feeling and writability of plain paper, and this can be applied for forming a gradation image such as photographs together with characters, symbols, etc. on visiting card, post card, advertising leaflets, personal history statement, personal records, identification cards, driver's license, season tickets, membership cards or on a booklet such as passport, pocketbook, coupon tickets, notebook, etc.

What is claimed is:

1. An image forming apparatus for forming a gradation image and a non-gradation image on a paper mount, characterized in that there are provided means for matching an inputted gradation image with a non-gradation image, image processing means comprising layout means for determining an arrangement of said two images, and data file generating means for forming data corresponding to the two images laid out, means for forming a dye receiving layer on a paper mount based on the data formed by said data file generating means, and thermal transfer means for forming a gradation image of the dye receiving layer based on said data formed by said data file generating means.

2. An image forming apparatus according to claim 1, wherein there is provided means for forming a non-gradation image.

3. An image forming apparatus according to claim 1, wherein said non-gradation image is formed on a paper mount in advance.

4. An image forming apparatus according to claim 1, wherein there is provided means for forming a protective layer at least in a part of the image formed on the paper mount.

5. An image forming apparatus according to claim 1, wherein said paper mount is in the form of a visiting card or a post card.

6. An image forming apparatus, comprising receiving layer transfer means for forming a receiving layer stainable with sublimation dye on a member to be recorded, sublimation transfer means for forming an image by shifting the sublimation dye from a thermal transfer sheet having a dye layer containing a sublimation dye toward a receiving layer of the member to be recorded, and an image processing control means for outputting image information to the receiving layer transfer means and a sublimation transfer means and for controlling the two transfer means, characterized in that said image processing control means is provided with an image area identifying unit and drives and controls the receiving layer transfer means based on identifying data from the image area identifying unit.

7. An image forming apparatus according to claim 6, wherein said image area identifying unit comprises a line drawing area identifying unit and a gradation image area identifying unit.

8. An image forming apparatus, comprising sublimation transfer means for forming an image by shifting a sublimation dye from a thermal transfer sheet having a dye layer containing a sublimation dye to a receiving layer of a member to be recorded, and an image processing control means provided with an image area identifying unit and for outputting image information to the sublimation transfer means and for controlling the sublimation transfer means, characterized in that said thermal transfer sheet is provided with a receiving layer stainable with sublimation dye and sequentially arranged with a dye layer, and said image processing control means drives and controls the sublimation transfer means based on the data identified by the image area identifying unit and transfers the receiving layer to the member to be recorded.

9. An image forming apparatus according to claim 8, wherein said image area identifying unit comprises a line drawing area identifying unit and a gradation image area identifying unit.

* * * * *